US007306122B2

(12) United States Patent
Stark et al.

(10) Patent No.: US 7,306,122 B2
(45) Date of Patent: Dec. 11, 2007

(54) TRIGGER SPRAYER VENTING SYSTEM

(75) Inventors: Jeffrey P. Stark, Wentzville, MO (US); Walter J. Clynes, St. Peters, MO (US)

(73) Assignee: Continental AFA Dispensing Company, St. Peters, MO (US)

( * ) Notice: Subject to any disclaimer, the term of this patent is extended or adjusted under 35 U.S.C. 154(b) by 202 days.

(21) Appl. No.: 10/961,286

(22) Filed: Oct. 8, 2004

(65) Prior Publication Data

US 2006/0076364 A1 Apr. 13, 2006

(51) Int. Cl.
*B67D 5/42* (2006.01)

(52) U.S. Cl. ..... 222/383.1; 222/481.5; 239/333

(58) Field of Classification Search ..... 222/321.7, 222/321.9, 383.1, 481.5; 239/333
See application file for complete search history.

(56) References Cited

U.S. PATENT DOCUMENTS 4,072,252 A 2/1978 Steyns et al.
4,230,277 A 10/1980 Tada
4,350,298 A 9/1982 Tada
4,815,663 A 3/1989 Tada
4,819,835 A * 4/1989 Tasaki ..... 222/383.1
4,958,754 A * 9/1990 Dennis ..... 222/383.1
5,337,928 A 8/1994 Foster et al.
5,996,847 A * 12/1999 Smolen et al. ..... 222/137
2006/0086762 A1* 4/2006 Foster et al. ..... 222/383.1
2006/0086763 A1* 4/2006 Foster ..... 222/383.1

* cited by examiner

*Primary Examiner*—Joseph A. Kaufman
(74) *Attorney, Agent, or Firm*—Thompson Coburn LLP

(57) ABSTRACT

A venting system of a manually operated trigger sprayer vents the interior of a liquid container connected to the trigger sprayer. The trigger sprayer is provided with a vent chamber that surrounds the pump chamber, and a vent piston that surrounds the pump piston. The vent piston is received in the vent chamber for reciprocating movements with the pump piston in the pump chamber. The reciprocating movement of the vent piston alternatively opens the vent chamber to the exterior environment of the trigger sprayer and thereby vents the interior of the liquid container connected to the trigger sprayer, and closes the vent chamber thereby sealing the interior of the liquid container from the exterior environment.

13 Claims, 2 Drawing Sheets

TRIGGER SPRAYER VENTING SYSTEM

BACKGROUND OF THE INVENTION (1) Field of the Invention

The present invention pertains to a venting system for a manually operated, liquid dispensing trigger sprayer. More specifically, the present invention pertains to improvements to a venting system of a manually operated trigger sprayer that vents the interior of a liquid container connected to the trigger sprayer. For the most part, the construction of the trigger sprayer is typical and includes a sprayer housing having a pump chamber, a pump piston mounted in the pump chamber for reciprocating movement, and a trigger mounted on the sprayer housing for manual manipulation of the trigger which reciprocates the pump piston in the pump chamber. The improvement comprises a vent chamber that surrounds the pump chamber and a vent piston that surrounds the pump piston. The vent piston is received in the vent chamber for reciprocating movements with the pump piston in the pump chamber. The reciprocating movement of the vent piston alternatively opens the vent chamber to the exterior environment of the trigger sprayer and thereby vents the interior of the liquid container connected to the trigger sprayer, and closes the vent chamber thereby sealing the interior of the liquid container from the exterior environment.

(2) Description of the Related Art

A typical manually operated liquid dispensing trigger sprayer comprises a sprayer housing that has a nozzle for dispensing liquid, a trigger mounted on the sprayer housing for movement of the trigger relevant to the housing, a pump chamber on the housing, and a pump piston operatively connected to the trigger and received in the pump chamber for reciprocating movement of the piston in the pump chamber in response to manual movement of the trigger, and a connector attaching the trigger sprayer to a liquid container. The reciprocating movement of the pump piston in the pump chamber alternately draws liquid from the liquid container into the pump chamber, and then pumps the liquid out of the pump chamber and dispenses the liquid through the nozzle of the sprayer housing as a spray or stream.

Trigger sprayers of this type are often provided with some system of venting the interior of the liquid container connected to the trigger sprayer. This allows air to enter the container interior and occupy that portion of the internal volume of the container that is vacated by the liquid dispensed from the container by the trigger sprayer.

Many different types of trigger sprayer venting systems have been developed in the prior art. One type of venting system employs a resilient diaphragm valve that is positioned in the interior of the sprayer housing covering over a vent hole in the sprayer housing. The vent hole communicates the interior of the sprayer housing and the interior of the connected liquid container with the exterior environment of the sprayer. A plunger is provided on the trigger member of the trigger sprayer and is positioned just outside of the vent hole. On manual manipulation of the trigger, the plunger is inserted through the vent hole and engages the diaphragm valve, displacing the diaphragm valve from its position over the vent hole. This vents the interior of the liquid container. On the return movement of the trigger the plunger is retracted out of the vent hole and the resilience of the diaphragm valve allows it to resume its position over the vent hole.

However, these prior art venting systems have been found to be disadvantaged in that repeated use of the trigger sprayer causes repeated displacement of the diaphragm valve from the sprayer vent hole. The resiliency of the diaphragm valve is effected by these repeated displacements and the valve is no longer able to immediately reposition itself over the vent hole once the plunger is retracted from the vent hole. This can result in liquid leaking from the container through the vent hole should the container and trigger sprayer be knocked over on one side before the diaphragm valve repositions itself over the vent hole.

Another type of venting system employs a vent cylinder on the sprayer housing and a vent piston operatively connected to the trigger of the trigger sprayer. The vent hole is positioned in the side of the cylinder and one or more small ribs are formed on the interior surface of the cylinder in the area of the vent hole. The vent piston engages in a sliding, sealing engagement with the interior surface of the vent cylinder. As the trigger is manipulated, the vent piston is pushed through the vent cylinder toward the vent hole and the ribs. The ribs engage with the periphery of the vent piston and displace the periphery from the interior surface of the vent cylinder, thereby communicating the exterior environment of the trigger sprayer around the piston and through the vent cylinder and the vent hole to the interior of the liquid container.

This venting system has been found to be disadvantaged in that after repeated use of the trigger sprayer, the ribs in the vent cylinder have a tendency to deform the resilient material around the periphery of the vent piston. This detracts from the ability of the vent piston to seal against the interior surface of the vent cylinder, and can result in leakage of liquid from the liquid container through the vent cylinder.

It has also been noted that venting systems employing venting cylinders of the type described above have been disadvantaged in that the molding of the sprayer housing must be closely monitored to ensure that no imperfections develop in the vent cylinder of the housing. Because the sprayer housing is molded with a pump cylinder and a vent cylinder in close proximity to each other, sinks can often form in the interior surfaces of the pump cylinder and vent cylinder as the molded plastic of the sprayer housing cools. When sinks form as slight indentations in the interior walls of the pump cylinder and vent cylinder they can prevent the pump piston and vent piston peripheries from engaging in a sealing engagement with the pump and vent cylinder interior surfaces. This can result in leakage of liquid from the trigger sprayer.

SUMMARY OF THE INVENTION

The present invention overcomes disadvantages associated with prior art venting systems of trigger sprayers by providing an improved trigger sprayer venting system that vents air to the liquid container connected to the trigger sprayer early in the pump piston stroke and for an extended period of the pump piston stroke, while preventing liquid from leaking through the venting system should the trigger sprayer and liquid container be turned on one side.

Much of the construction of the trigger sprayer of the invention is common to trigger sprayers. The trigger sprayer is generally constructed with a sprayer housing that is connected by a separate connector to a fluid container. The sprayer housing is formed with a liquid pump chamber that communicates with a liquid supply passage and a liquid discharge passage that both extend through the sprayer housing. A pump piston is mounted in the pump chamber for reciprocating movement. A trigger is mounted on the sprayer housing for manual manipulation. The trigger is operatively connected with the pump piston and manipulation of the trigger reciprocates the pump piston in the pump chamber. Reciprocation of the pump piston alternatively draws liquid from the liquid container through the liquid supply passage to the pump chamber, and then pumps the liquid from the pump chamber through the liquid discharge passage and dispenses the liquid from the sprayer housing as a spray or stream.

The trigger sprayer of the invention differs in construction from that of prior art trigger sprayers in the venting system provided on the trigger sprayer. The venting system is basically comprised of a vent chamber and a vent piston received inside the vent chamber for reciprocating movement of the vent piston relative to the vent chamber.

The vent chamber is formed on the sprayer housing around the pump chamber of the trigger sprayer. The vent chamber has a cylindrical side wall that extends around and surrounds the pump chamber. This coaxial positioning of the pump chamber and vent chamber relative to each other reduces the probability of sinks forming in the side walls of the pump chamber and vent chamber as the plastic employed in molding the trigger sprayer cools.

A vent hole is provided in a back wall of the vent chamber and communicates the interior volume of the vent chamber with the interior of the liquid container connected to the trigger sprayer. By positioning the vent hole in the back wall of the vent chamber, the vent hole is spaced from the vent piston as the vent piston reciprocates in the vent chamber. This prevents the vent hole from adversely affecting the seal provided between the periphery of the vent piston and the interior of the vent chamber.

The vent chamber has a cylindrical interior surface with a first interior diameter dimension adjacent the vent hole in the back wall of the vent chamber. The interior diameter dimension remains consistent for a majority of the length of the vent chamber as it extends from the back wall. As the vent chamber approaches a distal end of the vent chamber remote from the back wall, the interior diameter dimension of the vent chamber interior surface gradually decreases, forming a necked down interior surface of the vent chamber adjacent the chamber distal end.

With the vent chamber being coaxial with the pump chamber, the vent piston is formed coaxially around the pump piston. The vent piston is formed of the same resilient material as the pump piston. In a first position of the vent piston relative to the vent chamber, the peripheral surface of the vent piston engages in a sealing engagement with the necked down portion of the vent chamber interior surface. This seals the interior of the vent chamber from the exterior environment of the trigger sprayer and prevents unintended liquid leakage from the liquid container through the trigger sprayer vent chamber. On actuation of the liquid pump, the vent piston moves with the pump piston. The vent piston moves away from the necked down portion of the vent chamber interior surface toward the vent hole at the back wall of the vent chamber. This movement of the vent piston causes the peripheral surface of the vent piston to disengage from the interior surface of the vent chamber, thereby establishing a venting path between the vent piston peripheral surface and the vent chamber interior surface. This allows the interior of the liquid container connected to the trigger sprayer to vent through the vent chamber to the exterior environment of the trigger sprayer.

With the novel construction of the venting system of the invention described above, the trigger sprayer of the invention overcomes disadvantages commonly associated with prior art trigger sprayer venting systems.

BRIEF DESCRIPTION OF THE DRAWINGS

Further features of the present invention are set forth in the following detailed description of the preferred embodiment of the invention and in the drawing figures wherein.

DETAILED DESCRIPTION OF THE PREFERRED EMBODIMENT

Figure 1:
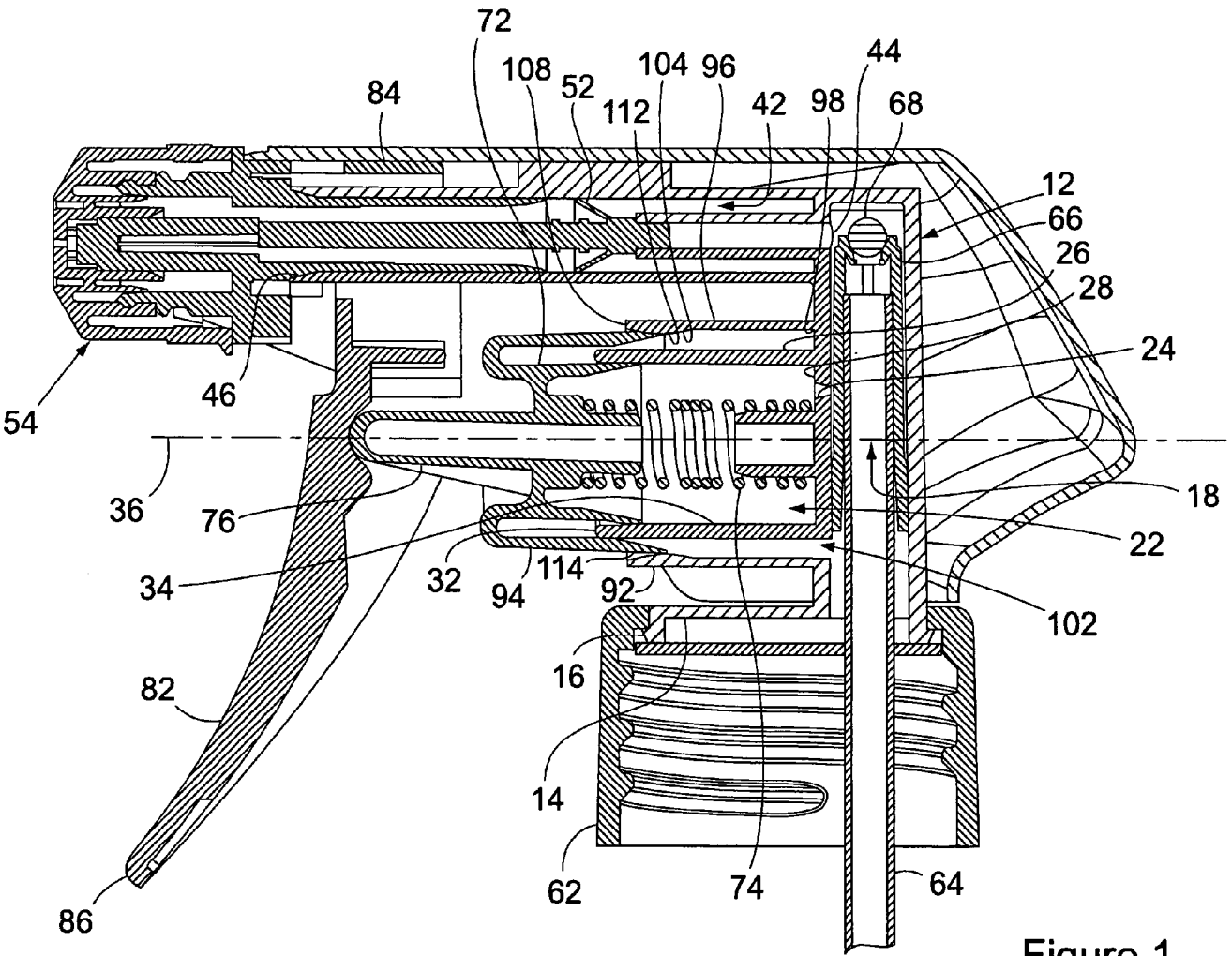
FIG. 1 is a side elevation view, in section, of the trigger sprayer apparatus of the invention in the first position of the vent piston relative to the vent chamber; and, FIG. 2 is a side elevation view, in section, of the trigger sprayer of FIG. 1 with the vent piston in its second position relative to the vent chamber.
Figure 2:
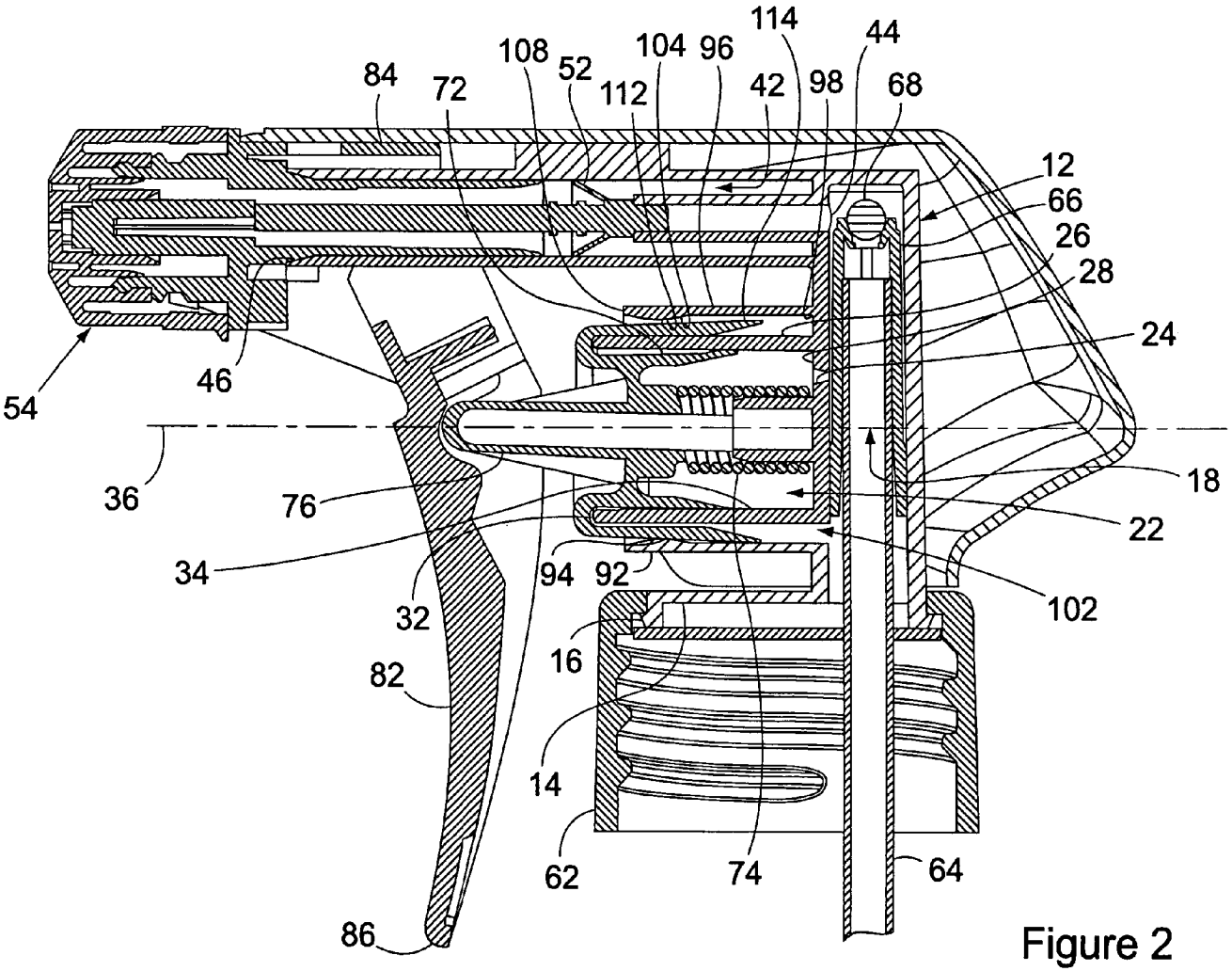

FIGS. 1 and 2 show side sectioned views of the trigger sprayer of the invention that includes the novel venting system of the invention. Many of the component parts and the details of construction of the trigger sprayer shown in FIGS. 1 and 2 are common to trigger sprayers of the prior art. Therefore, these will only be described generally. The novel venting system of the invention will be described in more detail. As is typical in the construction of trigger sprayers, most of the component parts are constructed of a plastic material.

The trigger sprayer comprises a sprayer housing 12 that is molded with many of the component parts of the trigger sprayer. The bottom of the sprayer housing 12 is formed with a circular disk 14 having a peripheral flange 16. An opening passes through the disk 14 and a liquid supply passage 18 extends upwardly through the sprayer housing from the disk. A pump chamber 22 is formed on the sprayer housing 12 and communicates through a pump port 24 with the liquid supply passage 18.

The pump chamber 22 is defined by a cylindrical side wall 26 of the chamber. The chamber also has a circular end wall 28. The pump port 24 passes through the end wall 28. The pump chamber side wall 26 extends from the end wall 28 to a distal end 32 of the side wall. The side wall distal end 32 surrounds a circular opening into the interior of the pump chamber. The side wall 26 has a cylindrical interior surface 34 that defines a center axis 36 of the pump chamber 22.

A liquid discharge passage 42 is also formed in the sprayer housing 12. The liquid discharge passage 42 has a length with a proximal end 44 that communicates with the liquid supply passage 18, and an opposite distal end 46.

A check valve 52 is mounted in the liquid discharge passage 42, as is conventional. The check valve 52 permits liquid flow from the passage proximal end 44 to the passage distal end 46, and prevents the reverse flow. As is also conventional, a nozzle assembly 54 is mounted to the distal end 46 of the liquid discharge passage 42. Although particular constructions of the check valve 52 and nozzle assembly 54 are shown in the drawing figures, other equivalent types of valves and nozzle assemblies may be employed with the trigger sprayer of the invention.

A connector cap 62 is mounted on the circular flange 16 of the sprayer housing 12. The cap 62 is used in removably attaching the sprayer housing 12 to a separate liquid container. The cap 62 shown has internal screw threading for attachment to the liquid container. However, other equivalent types of connectors may be employed with the trigger sprayer of the invention.

A dip tube 64 extends upwardly through the cap 62 and through the opening in the bottom disk 14 of the sprayer housing 12. The dip tube 64 forms a portion of the liquid supply passage 18 that leads to the interior of the pump chamber 22. A valve seat assembly 66 is mounted over the upper end of the dip tube 64 as viewed in FIGS. 1 and 2. A ball valve 68 is positioned on the seat assembly 66. The ball valve 68 controls the flow of liquid through the liquid supply passage 18 to the pump chamber 22. The valve permits the flow of liquid through the supply passage 18 to the interior of the pump chamber 22, and prevents the reverse flow of liquid.

A cylindrical pump piston 72 is mounted in the interior of the pump chamber 22 for reciprocating movements in the pump chamber. The pump piston 72 is moveable in the pump chamber 22 between a first position of the piston shown in FIG. 1, and a second position of the piston shown in FIG. 2. A coil spring 74 engages between the piston 72 and the end wall 28 of the pump chamber. The spring 74 biases the pump piston 72 to its first position. The pump piston 72 is formed integrally with a piston rod 76 that extends outwardly from the pump piston and engages with a trigger 82 of the trigger sprayer.

The trigger 82 has a length with opposite proximal 84 and distal 86 ends. The trigger proximal end 84 mounts the trigger 82 to the sprayer housing 12 for movement of the trigger relative to the sprayer housing. Preferably, the trigger 82 pivots relative to the sprayer housing 12. The trigger 82 operative connection to the piston rod 76 and the pump piston 72 causes the reciprocating movement of the pump piston in the pump chamber 22 in response to movements of the trigger.

A shroud 92 covers over much of the exterior of the sprayer housing 12. The shroud 92 gives an aesthetically pleasing appearance to the trigger sprayer.

Much of the construction of the trigger sprayer described to this point is conventional. The novel venting system of the trigger sprayer is provided by a vent chamber 92 and a vent piston 94.

The vent chamber 92 is comprised of a cylindrical side wall 96 and a circular end wall 98 that is coplanar with and an extension of the pump chamber end wall 28. The vent chamber side wall 96 extends around and surrounds the pump chamber 22. A vent opening 102 passes through the end wall 98 and communicates an interior volume of the vent chamber 92 with the interior of the liquid supply passage 18. The vent chamber side wall 96 has a cylindrical interior surface 104 that defines a center axis of the vent chamber. The vent chamber center axis is coaxial with the pump chamber center axis 36. The vent chamber interior surface 104 has a consistent interior diameter dimension as the side wall 96 extends from the end wall 98 toward a distal end 108 of the side wall. As the vent chamber side wall 96 approaches the distal end 108, a portion 112 of the side wall interior surface necks down to a smaller interior diameter dimension compared to that of the rest of the side wall interior surface 104.

The vent piston 94 is an integral part of the pump piston 72 and the piston rod 76. The vent piston 94 is cylindrical and extends around and surrounds the pump piston 72. Thus, the vent piston 94 and pump piston 72 have the same center axis. As seen in FIGS. 1 and 2, the pump piston 72 is entirely contained inside the vent piston 94. The vent piston 94 extends from the piston rod 76 across the pump piston 72 to a peripheral end portion 114 of the vent piston. This peripheral end portion 114 of the vent piston engages in a sliding, sealing engagement with the interior surface 104 of the vent chamber 92. As seen in FIG. 1, the vent piston end portion 114 tapers slightly radially away from the remainder of the vent piston 94 as it extends to the distal end of the vent piston. This provides for a resilient sealing engagement of the vent piston peripheral end portion 114 with the necked down portion 112 of the vent chamber interior surface 104 in the first position of the vent piston shown in FIG. 1. In this first position of the vent piston 94, the sealing engagement of the vent piston peripheral surface portion 114 with the necked down portion 112 of the vent chamber seals the exterior environment of the trigger sprayer from the interior of the vent chamber 94 and the interior of the liquid container connected to the trigger sprayer.

On operation of the trigger sprayer, as the trigger 82 is squeezed to the position shown in FIG. 2, the vent piston 94 moves to its second position relative to the vent chamber 92. In the second position of the vent piston 94 shown in FIG. 2, the peripheral surface portion 114 of the vent piston becomes disengaged from the necked down portion 112 of the vent chamber side wall. This provides a flow path of venting air from the exterior environment of the trigger sprayer through the vent chamber 92 between the vent piston 94 and the vent chamber side wall 96 and through the vent chamber opening 102 to the interior of liquid container connected to the trigger sprayer. In this manner, on operation of the liquid pump of the trigger sprayer, the interior of the liquid container connected to the trigger sprayer is vented.

On release of the trigger 82, the coil spring 74 returns both the pump piston 72 and vent piston 94 to their positions shown in FIG. 1. In the position of the vent piston 94 shown in FIG. 1, the peripheral surface portion 114 of the vent piston again engages in sealing engagement with the necked down portion 112 of the vent chamber side wall 96, thus sealing the interior of the vent chamber 94 from the exterior environment of the sprayer.

With the novel construction of the venting system of the invention described above, the trigger sprayer of the invention overcomes disadvantages commonly associated with prior art trigger sprayer venting systems.

Although the trigger sprayer of the invention has been described above with reference to a specific embodiment of the sprayer, it should be understood that other variations of the sprayer may be arrived at without departing from the invention's scope of protection provided by the following claims.

The invention claimed is:

1. A manually operated, liquid dispensing tripper sprayer comprising:

a sprayer housing;

a liquid pump on the sprayer housing, the liquid pump having a center axis;

an air vent on the sprayer housing, the air vent having a center axis, the air vent center axis being coaxial with the liquid pump center axis;

a liquid discharge passage extending through the sprayer housing and communicating with the liquid pump for directing liquid through the sprayer housing and discharging the liquid from the sprayer housing on operation of the liquid pump;

a trigger mounted on the sprayer housing for movement of the trigger relative to the sprayer housing, the trigger being operatively connected to the liquid pump for operation of the liquid pump in response to movement of the trigger;

the liquid pump having a pump chamber with a cylindrical interior surface, and a pump piston mounted in the pump chamber for reciprocating movement relative to the pump chamber;

the air vent having a vent chamber with a cylindrical interior surface, and a vent piston mounted in the vent chamber for reciprocating movement relative to the vent chamber; and the pump piston being positioned inside the vent piston.

2. The trigger sprayer of claim 1, further comprising:

the pump chamber being positioned inside the vent chamber interior surface.

3. The trigger sprayer of claim 1, further comprising:

the vent chamber interior surface extending around the pump chamber.

4. A manually operated, liquid dispensing trigger sprayer comprising:

a sprayer housing;

a liquid pump on the sprayer housing, the liquid pump having a center axis;

an air vent on the sprayer housing, the air vent having a center axis, the air vent center axis being coaxial with the liquid pump center axis;

a liquid discharge passage extending through the sprayer housing and communicating with the liquid pump for directing liquid through the sprayer housing and discharging the liquid from the sprayer housing on operation of the liquid pump;

a trigger mounted on the sprayer housing for movement of the trigger relative to the sprayer housing, the trigger being operatively connected to the liquid pump for operation of the liquid pump in response to movement of the trigger;

the liquid pump having a pump chamber with a cylindrical interior surface, and a pump piston mounted in the pump chamber for reciprocating movement relative to the pump chamber;

the air vent having a vent chamber with a cylindrical interior surface, and a vent piston mounted in the vent chamber for reciprocating movement relative to the vent chamber; and, the vent piston extending around the pump piston.

5. A manually operated liquid dispensing trigger sprayer comprising:

a sprayer housing;

a liquid pump chamber having a pump chamber sidewall on the sprayer housing;

an air vent chamber having a vent chamber sidewall on the sprayer housing, the vent chamber sidewall extending around the pump chamber sidewall and surrounding the pump chamber;

a liquid discharge passage extending through the sprayer housing and communicating with the pump chamber for directing liquid from the pump chamber, through the sprayer housing, and discharging the liquid from the sprayer housing;

a pump piston mounted in the pump chamber for reciprocating movement of the pump piston in the pump chamber;

a vent piston mounted in the vent chamber for reciprocating movement of the vent piston in the vent chamber; and, a trigger mounted on the sprayer housing for movement of the trigger relative to the sprayer housing, the trigger being operatively connected to the pump piston and the vent piston for reciprocating movement of the pump piston and vent piston in the respective pump chamber and vent chamber in response to movement of the trigger.

6. The trigger sprayer of claim 5, further comprising:

the pump chamber sidewall having a cylindrical interior surface with a center axis;

the vent chamber sidewall having a cylindrical interior surface with a center axis; and, the pump chamber center axis being coaxial with the vent chamber center axis.

7. The trigger sprayer of claim 5, further comprising:

the pump piston being positioned inside the vent piston.

8. The trigger sprayer of claim 5, further comprising:

the vent piston extending around and surrounding the pump piston.

9. The trigger sprayer of claim 5, further comprising:

the pump piston being cylindrical and having a center axis;

the vent piston being cylindrical and having a center axis; and, the pump piston and the vent piston being coaxial.

10. The trigger sprayer of claim 5, further comprising:

the trigger having a length with opposite proximal and distal ends, the trigger proximal end being mounted to the sprayer housing for movement of the trigger relative to the sprayer housing, and the trigger length projecting from the sprayer housing to the trigger distal end.

11. A manually operated liquid dispensing trigger sprayer comprising:

a sprayer housing;

a liquid pump chamber on the sprayer housing;

an air vent chamber on the sprayer housing;

a liquid discharge passage communicating with the liquid pump chamber and extending through the sprayer housing for directing liquid from the pump chamber, through the sprayer housing, and discharging the liquid from the sprayer housing;

a pump piston mounted in the pump chamber for reciprocating movement of the pump piston in the pump chamber, the pump piston being cylindrical and having a center axis;

a vent piston mounted in the vent chamber for reciprocating movement of the vent piston in the vent chamber, the vent piston being cylindrical and having a center axis that is coaxial with the pump piston center axis;

a trigger mounted on the sprayer housing for movement of the trigger relative to the sprayer housing, the trigger being operatively connected to the pump piston and the vent piston for reciprocating movement of the pump piston and vent piston in the respective pump chamber and vent chamber in response to movement of the trigger; and, the vent piston extending around and surrounding the pump piston.

12. The trigger sprayer of claim 11, further comprising:

the pump piston being positioned inside the vent piston.

13. The trigger sprayer of claim 11, further comprising:

the pump chamber being positioned inside the vent chamber.

* * * * *